US006470965B1

(12) United States Patent
Winzer

(10) Patent No.: US 6,470,965 B1
(45) Date of Patent: Oct. 29, 2002

(54) DEVICE FOR INTRODUCING A HIGH PRESSURE FLUID INTO WELL HEAD COMPONENTS

(76) Inventor: Colin Winzer, 30 White Cap Close, Sylvan Lake (CA), I4S 1K1

( * ) Notice: Subject to any disclaimer, the term of this patent is extended or adjusted under 35 U.S.C. 154(b) by 36 days.

(21) Appl. No.: 09/649,075

(22) Filed: Aug. 28, 2000

(51) Int. Cl.[7] ..... E21B 19/00; E21B 33/03

(52) U.S. Cl. ..... 166/77.4; 166/85.3; 166/86.1; 166/90.1; 166/179; 166/317; 166/376; 166/379

(58) Field of Search ..... 166/75.13, 77.1, 166/77.4, 85.1, 85.3, 86.1, 90.1, 97.1, 179, 317, 376, 379, 387

(56) References Cited

U.S. PATENT DOCUMENTS 4,023,814 A * 5/1977 Pitts ..... 166/90.1 X
4,111,261 A * 9/1978 Oliver ..... 166/77.1 X
4,241,786 A * 12/1980 Bullen ..... 166/77.4
4,632,183 A * 12/1986 McLeod ..... 166/77.4
4,688,641 A * 8/1987 Knieriemen ..... 166/387
4,867,243 A * 9/1989 Garner et al. ..... 166/77.4 X
5,012,865 A * 5/1991 McLeod ..... 166/90.1
5,060,723 A * 10/1991 Sutherland et al. .... 166/77.4 X
5,261,487 A * 11/1993 McLeod et al. ..... 166/85.3
5,285,852 A * 2/1994 McLeod ..... 166/379
5,332,044 A * 7/1994 Dallas et al. ..... 166/86.1 X
5,927,405 A * 7/1999 Monjure et al. ..... 166/90.1 X
6,315,050 B2 * 11/2001 Vaynshteyn et al. ..... 166/376

* cited by examiner

*Primary Examiner*—George Suchfield
(74) *Attorney, Agent, or Firm*—Bennett Jones LLP

(57) ABSTRACT

A device for introducing high-pressure fluid through a well having a vertical passage with at least one valve and into a well having a well tubing into said vertical passage, has a lower part removably attachable to the well tubing, a hollow mandrel adapted to extend through the inner passage of the lower part and having a passage through which a high pressure fluid can be introduced, an upper part firmly connected with the mandrel to hold the mandrel and movable relative to the lower part between a distal position in which the upper part is spaced from the lower part and the mandrel is not introduced into the well tubing and a proximal position in which the upper part is located close to the lower part and the mandrel is introduced into the well tubing and passes through an area of the well tubing provided with the valve, so that when the high pressure fluid is introduced through the mandrel it can not affect the valve, the upper part having a port communicating the inner passage of the upper part with an outer side of the upper part, so that a pressure can be equalized through the port, or the well can be flowed through valve to a container.

10 Claims, 4 Drawing Sheets

DEVICE FOR INTRODUCING A HIGH PRESSURE FLUID INTO WELL HEAD COMPONENTS

BACKGROUND OF THE INVENTION

The present invention relates to a device for introducing a high pressure fluid through a well tree into a well.

A wellhead of a production of or gas well has a number of valves including safety valves for blocking off the flow of oil or gas from the well when required, and other valves for selecting different passages for oil or gas or for introducing additives, which together form a so-called "well tree". During production in the well it is sometimes desirable to stimulate the well by a fracturing technique which involves injection into well of a pressurized fluid, such as water, brine, foam and the like to break or fracture the oil or gas producing formations down the well. During the fracturing process a high pressure is developed which can damage some wells. For this reason, special devices are used for introducing a high pressure fluid, which prevent damages to the valves.

Devices of the above mentioned general type are known in the art. Some of such devices are disclosed for example in U.S. Pat. Nos. 4,632,183; 5,020,590; 5,060,723; 5,285,852. The known device has a lower part connectable to upper part of a well tubing, and an upper part which holds a hollow high-pressure resistant mandrel and is movable relative to the lower part between a distal position in which is spaced from the lower part and the mandrel is located higher, and a proximal position in which the upper part is located close to lower part and the mandrel is introduced into the well tubing through the area of valves which have to be protected from the action of the high pressure fluid. The mandrel prevents the action of the high pressure fluid onto the well and therefore protects the valves from damage by the high pressure fluid.

Traditionally when an oil well is "fraced" from fracture, pressure fluid is introduced under pressure to effectively fracture the substrate and to fill it with porous sand, to prevent it from closing after the pressure is lowered. If it is necessary to stop the procedure, either premature or at completion. a second line is connected and pressure is bled off over a few hours. The crew must wait for pressure to lower and equalize between well head tools and the depth of the well before disconnection and leaving of the crew.

SUMMARY OF THE INVENTION

Accordingly, it is an object of present invention to provide a device for introducing a high pressure fluid through a well tree into a well, which avoids the disadvantages of the prior art.

In keeping with these objects and with others which will become apparent hereinafter, one feature of present invention resides, briefly stated in a device for introducing a high pressure fluid into a well which has a valve tree attached to the well, which device has a lower part having an inner passage and removably attachable to an upper part a well tubing a hollow mandrel adapted to extend through said inner passage of said lower part and having an inner passage through which a high pressure fluid can be introduced; an upper part having an inner passage and firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced through the valves into the tubing which is provided with valves, so that when the high pressure fluid is introduced through the mandrel it can not affect the valves, said upper part having a port communicating with said inner passage of said upper part with an outer side of said upper part, so that a pressure can be equalized through said port.

When the upper part of the device is provided with the above mentioned port, the interior of the upper part communicates with an outer side and therefore the pressure can be bled off and equalized, or the well can be flowed to a tank or other storage container, without flowing through the master valve of the tree saving device or disconnecting of the injection ine.

In accordance with a further feature of the present invention, an additional port is provided in the lower part of the device. The additional port in the lower part of the device first of all prevents a potential damage when there is a backflow of the high pressure fluid from the lower end of the mandrel upwardly since the backflow is bled outwardly through the port of the lower part. Secondly, the port of the upper part and the port of the lower part can be connected with one another to provide a pressure equalization.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
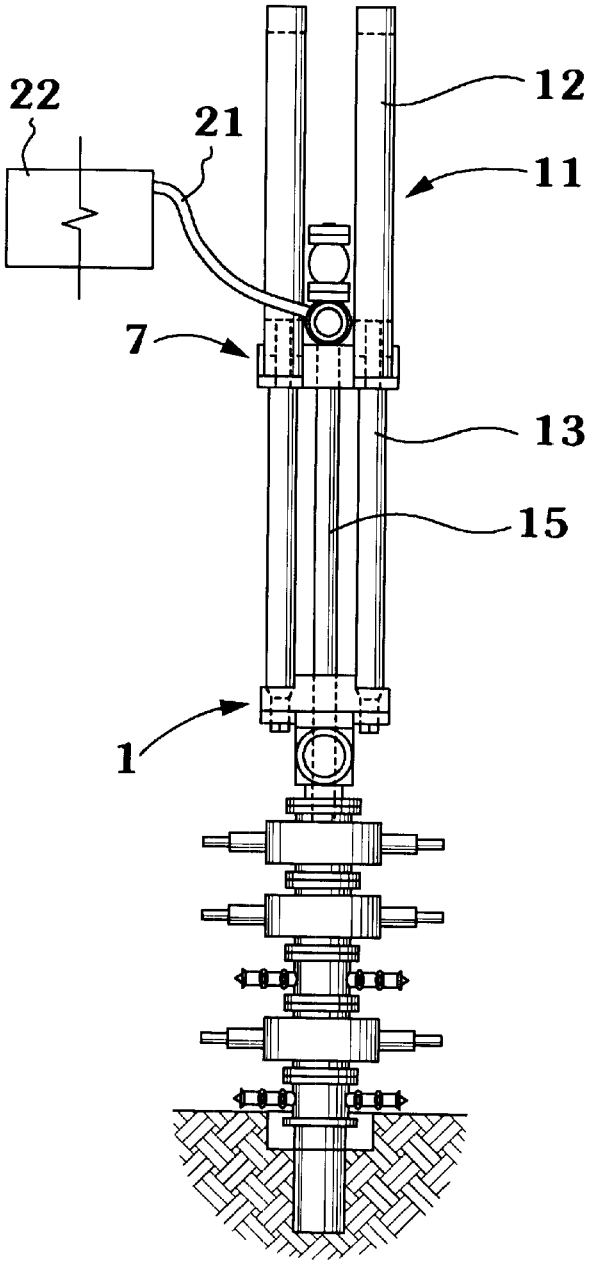
FIG. 1 is a view showing a device in accordance with the present invention which is installed in the area of a well head and is in extended position when an upper part is spaced from a lower part.
Figure 2:
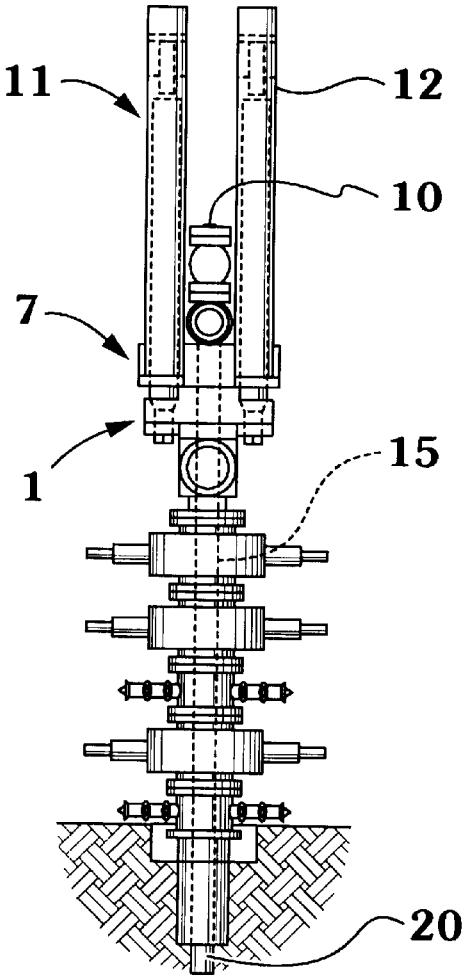
FIG. 2 is a view showing the device of FIG. 1 in a retracted position in which the upper part is locatod close to the lower part and a hollow protective mandrel is introduced in to a well tubing to protect valves from damage.
Figure 2A:
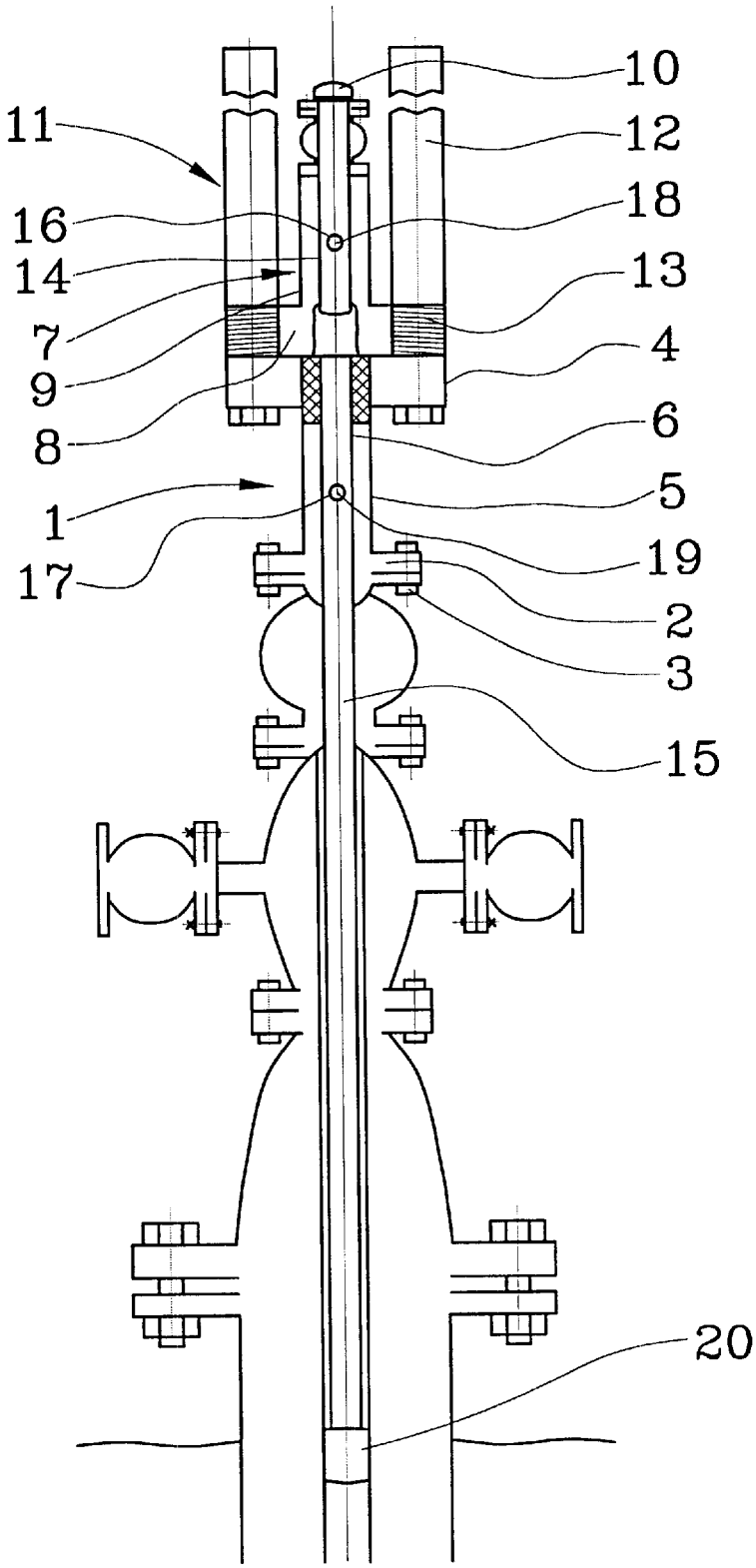
FIG. 2*a* is a partial sectional view showing another device in accordance with the present invention in a retracted position.
Figure 3:
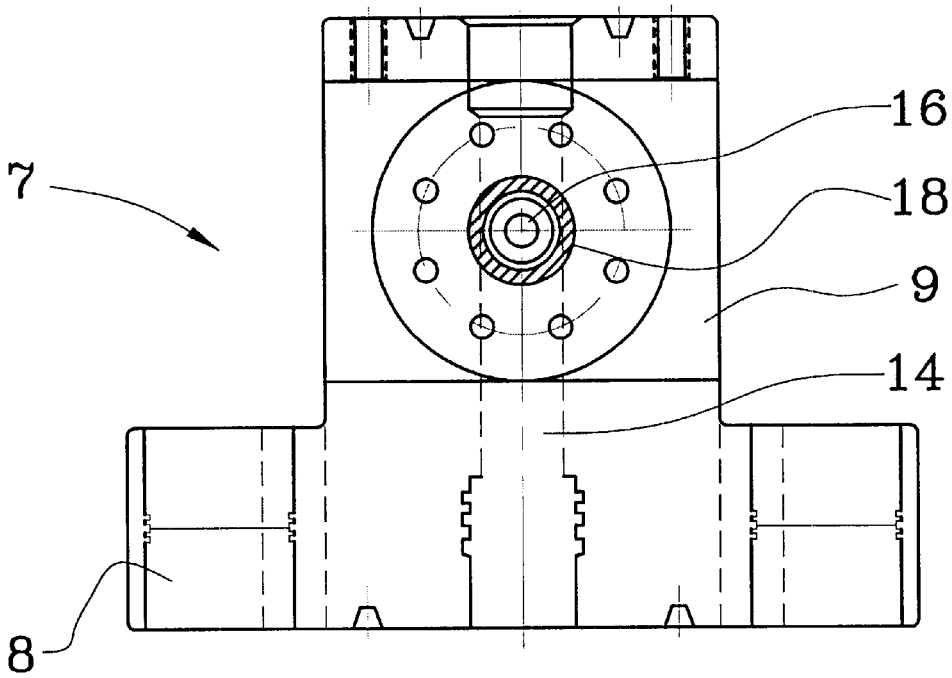
FIG. 3 is a view showing the upper part of the device in accordance with the invention with more details.
Figure 4:
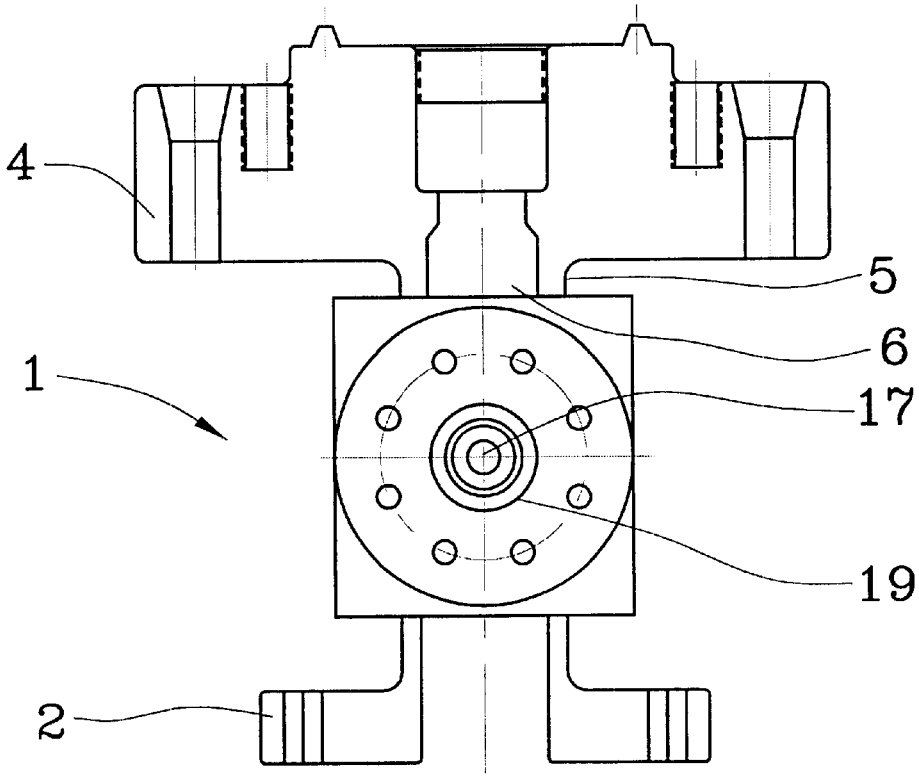
FIG. 4 is a view showing the lower part of the device in accordance with the invention with more details.
Figure 5:
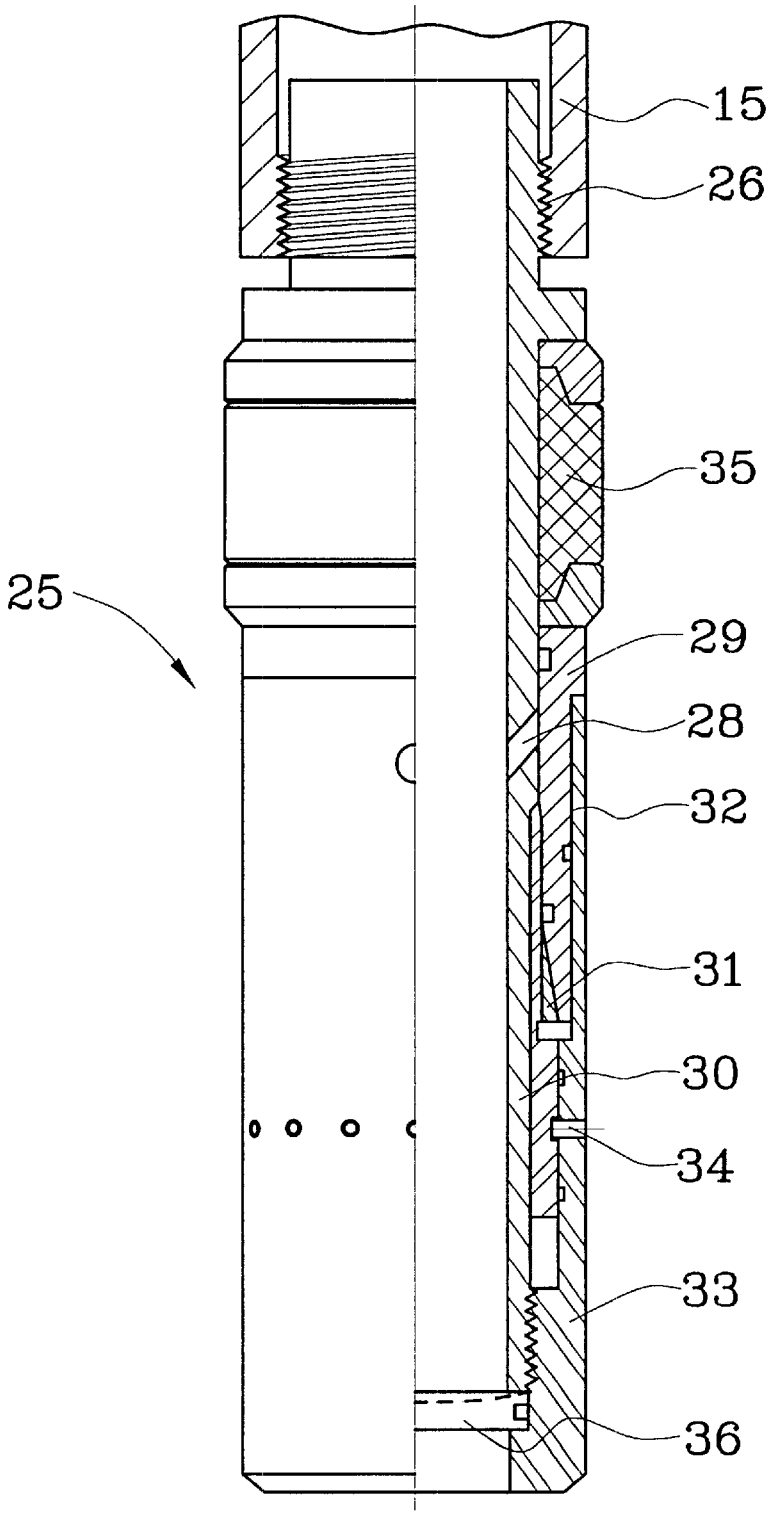
FIG. 5 is a one quarter sectional view through a packer useful in the present invention.

A device for a device for introducing a high pressure fluid through a well tree into a well includes a lower part which is identified as a whole with reference numeral 1. It has a lower flange 2 which is connectable with an upper part of a wellhead for example by bolts 3. For this purpose the lower part is provided with corresponding openings. The use of bolts connection reduces the height of the device. It also has an upper flange 4 and a tubular portion 5 connecting the lower flange 2 and the upper flange 4 with one another and having an inner passage 6.

The device further has an upper part which is identified with reference numeral 7. The upper part 7 has a lower flange 8 and a tubular portion 9 extending upwardly from the lower flange and provided with a valve 10 at the upper end comprising a main valve for upper part 7, as illustrated.

Two fluid-operated units 11 formed for example as hydraulic cylinder-piston units have cylinders 12 connected to the upper part 7, not shown pistons reciprocatingly movable in the cylinders, and piston rods 13 extending downwardly from the pistons and connected with their lower ends to the lower part 1. The units 11 are located radially outside of the tubular portion 9 which also reduces the height of the device. The upper part has an inner passage 14.

The device is further provided with a hollow mandrel 15 which is composed of high strength material capable of withstanding high pressure. The mandrel 15 is connected by its upper end with the upper part 7. For example, the mandrel 15 can be screwed in a central opening of the upper part 7 so as to be fixedly connected with the upper part. Seals are provided in the area of connection.

The upper part 7 has a port which is identified with reference numeral 16 and communicates the inner passage 14 of the upper part 7 with an outer side of the upper part. The lower part 1 also has a port which is identified with reference numeral 17 and communicates the inner passage 6 of the lower part 1 with an outer side. The port 16 can be provided with a closeable and openable valve 18, while the port 17 can be provided with a closeable and openable valve 19.

In order to introduce a high pressure fluid into the well, the device including the lower part 1, the upper part 7, and the mandrel 15 is assembled so that the upper part is in its distal position, or in other words spaced from the lower part. Then the lower part of the device is introduced onto the well head valve and the lower part 1 is connected to the well head valve by bolts or other fasteners, the cylinder-piston units are actuated by supplying the power fluid so that the piston rods are retracted into the cylinders, and the upper part 7 together with the mandrel 15 moves downwardly and the mandrel is introduced into the well tubing and passes through the area of the well tubing provided with the valves which have to be protected from the high pressure fluid. The valve of the mandrel is opened, and the high pressure fluid is introduced through the mandrel into the well tubing so as to flow downwardly through the well tubing and to the formation.

During the operation a lower seal 20 which is attached to the lower end of the mandrel seals the gap between the mandrel and the well tubing. If however for some reasons the sealing is not achieved or is interrupted, for example because the seal is damaged, etc., and the high pressure liquid flows out of the lower end of the mandrel upwardly around the mandrel, the port 17 of the lower part 1 will allow the high pressure fluid to escape and thereby prevents a possible damage to the equipment.

The port 16 of the upper part 7 is connected by a line 21 to a tank 22 or the like. Therefore the pressure can be bled off, and the pressure Is equalized between the well head tools and the depth of the well. It also allows a flow back of the well without disconnecting the injection line or flowing through the master valves of the tree saving device. These master valves will be closed while entering or exiting the mandrel from tubes, to provide high safety.

The port 17 of the lower part 1 also can be connected to the port 16 of the upper part 7, for providing the above mentioned pressure equalization.

The valve of the ports 16 and 17 are closed and opened by an operator during the corresponding periods of operation for performing the above mentioned functions.

In accordance with the present invention a new packer is used to provide sealing between the mandrel and the well tubing. The packer is identified as a whole with reference numeral 25. The packer is connected by a connection 26 formed for example as a thread to the lower end of the mandrel. It has an inner tubular member provided with a throughgoing opening 28, a plunger composed of an upper part 29 and a lower part 30 which are slidable relative to one another and also engage each other through ratchet 32 formed by interengaging ratchet teeth. The ratchet teeth are inclined so that the upper plunger part 29 is movable relative to the lower plunger part 30 upwardly but can not displace downwardly. An outer casing 33 is connected with the lower plunger portion 30 by a plurality of fasteners 34, for example pins. A sealing member 35 composed for example of an elastic material such as rubber and the like is located above the upper plunger portion 29. A burst disk 36 is attached to the bottom of the packer.

When the device is introduced into the well head and the high pressure fluid is supplied through the mandrel, it passes from the interior of the tubular member 26 through the opening 28 into a space between the plunger parts 29 and 30 and pushes the upper plunger member 29 upwardly so that the sealing member 35 is compressed and radially expanded or bulged so as to firmly and sealingly retain the packer and therefore the lower end of the mandrel in the well tubing. At a predetermined pressure the burst disk 36 bursts and the sealing element is set. When it is necessary to remove the device from the well head, the mandrel is pulled upwardly and pulls the tubular member 26 so that the fasteners 34 are sheared off. As a result the plunger 29, 30 slides down, and the sealing member 35 contracts with reduction of its outer diameter, so that the device can be easily removed from the well head.

It will be understood that each of the elements described above, or two or more together, may also find a useful application in other types of constructions differing from the types described above.

While the invention has been illustrated and described as embodied in a device for introducing a high pressure fluid through a well tree into a well, it is not intended to be limited to the details shown, since various modifications and structural changes maybe made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for introducing high-pressure fluid through a well having a vertical passage with at least one valve and into a well having a well tubing, the device comprising a lower part having an inner passage and removably attachable to an upper part of the well tubing; a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the valve, so that when the high pressure fluid is introduced through the mandrel it can not affect the valve, said upper part having a port communicating said inner passage of said upper part with an outer side of said upper part, so that a pressure can be equalized through said port of said upper part, said port of said upper part being provided with a valve adapted to close said port and to open said port correspondingly.

2. A device for introducing high-pressure fluid through a well having a vertical passage with at least one valve and into a well having a well tubing, the device comprising a lower part having an inner passage and removably attachable to an upper part of the well tubing; a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the valve, so that when the high pressure fluid is introduced through the mandrel it can not affect the valve, said upper part having a port communicating said inner passage of said upper part with an outer side of said upper part, so that a pressure can be equalized through said port of said upper part; and a line for connecting said port with a storage container for receiving the high pressure fluid from said inner passage of said upper part.

3. A device for introducing high-pressure fluid through a well having a vertical passage with at least one valve and into a well having a well tubing, the device comprising a lower part having an inner passage and removably attachable to an upper part of the well tubing; a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the valve, so that when the high pressure fluid is introduced through the mandrel it can not affect the valve, said upper part having a port communicating said inner passage of said upper part with an outer side of said upper part, so that a pressure can be equalized through said port of said upper part, said lower part having a port communicating said inner passage of said lower part with an outer side of said lower part, so that in the event of a flow of the high pressure fluid upwardly between said mandrel and said inner passage of the lower part, the high pressure fluid can escape through said port of said lower part.

4. A device as defined in claim 3, wherein said port of said upper part is connectable with said port of said lower part for providing equalization of pressure.

5. A device for introducing high-pressure fluid through a well having a vertical passage with at least one valve and into a well having a well tubing, the device comprising a lower part having an inner passage and removably attachable to an upper part of the well tubing; a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the valve, so that when the high pressure fluid is introduced through the mandrel it can not affect the valve, said upper part having a port communicating said inner passage of said upper part with an outer side of said upper part, so that a pressure can be equalized through said port of said upper part; and a high pressure fluid-operated means operative for moving said upper part relative to said lower part between said proximal position and said distal position, said high pressure fluid-operated means including two high pressure fluid-operated cylinder piston units located at both sides of an axis of said upper part and each having a cylinder connected with the said upper part and a piston rod extending from said cylinder and connected with said lower part.

6. A device for introducing high-pressure fluid through a well having a vertical passage with at least one well valve and into a well having a well tubing, the device comprising: a lower part having an inner passage and removably attachable to an upper part of the well tubing, a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the well valve, so that when the high pressure fluid is introduced through the mandrel it can not affect the well valve, said upper part having a port communicating said inner passage of said upper part with an outer side of said upper part, so that fluid can be flowed back from the well when the main valve is closed, said port of said upper part being provided with a valve adapted to close said port and to open said port correspondingly.

7. A device for introducing high-pressure fluid through a well having a vertical passage with at,least one valve and into a well having a well tubing, the device comprising a lower part having an inner passage and removably attachable to an upper part of the well tubing; a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the valve, so that when the high pressure fluid is introduced through the mandrel it can not affect the valve, said upper part having a port communicating said inner passage of said upper part with an outer side of said upper part, so that fluid can be flowed back from the well when the main valve is closed; and a line for connecting said port with a storage container for receiving the high pressure fluid from said inner passage of said upper part.

8. A device for introducing high-pressure fluid through a well having a vertical passage with at least one valve and into a well having a well tubing, the device comprising a lower part having an inner passage and removably attachable to an upper part of the well tubing; a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the valve, so that when the high pressure fluid is introduced through the mandrel it can not affect the valve, said upper part having a port communicating said inner passage of said upper part with an outer side of said upper part, so that fluid can be flowed back from the well when the main valve is closed, said lower part having a port communicating said inner passage of said lower part with an outer side of said lower part, so that in the event of a flow of the high pressure fluid upwardly between said mandrel and said inner passage of the lower part, the high pressure fluid can escape through said port of said lower part.

9. A device as defined in claim 8, wherein said port of said upper part is connectable with said port of said lower part for providing equalization of pressure, when said main valve on the upper part is closed.

10. A device for introducing high-pressure fluid through a well having a vertical passage with at least one valve and into a well having a well tubing, the device comprising a lower part having an inner passage and removably attachable to an upper part of the well tubing; a hollow mandrel adapted to extend through said inner passage of said lower part and having an inner passage through which a high pressure fluid can be introduced; an upper part having an inner passage and a main valve providing access to the inner passage and the upper part being firmly connected with said mandrel so as to hold said mandrel and movable relative to said lower part between a distal position in which said upper part is spaced from said lower part and said mandrel is not introduced into the well tubing and a proximal position in which said upper part is located close to said lower part and said mandrel is introduced into the well tubing and passes through an area of said well tubing provided with the valve, so that when the high pressure fluid is introduced through the mandrel it can not affect the valve, said upper part having a port communicating said inner passage of said upper part with an outer side of said upper part, so that fluid can be flowed back from the well when the main valve is closed; and a high pressure fluid-operated means operative for moving said upper part relative to said lower part between said proximal position and said distal position, said high pressure fluid-operated means including two high pressure fluid-operated cylinder piston units located at both sides of an axis of said upper part and each having a cylinder connected with the said upper part and a piston rod extending from said cylinder and connected with said lower part.

* * * * *